United States Patent [19]

Husson

[11] 4,261,439

[45] Apr. 14, 1981

[54] ELEVATOR SYSTEM

[75] Inventor: Alan L. Husson, Hackettstown, N.J.

[73] Assignee: Westinghouse Electric Corp., Pittsburgh, Pa.

[21] Appl. No.: 73,822

[22] Filed: Sep. 10, 1979

[51] Int. Cl.[3] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,747,710 | 7/1973 | Winkler | 187/29 |
| 3,774,729 | 11/1973 | Winkler | 187/29 |
| 4,130,184 | 12/1978 | Satoh et al. | 187/29 |
| 4,136,758 | 1/1979 | Tachino | 187/29 |
| 4,155,426 | 5/1979 | Booker, Jr. | 187/29 |

*Primary Examiner*—S. J. Witkowski
*Assistant Examiner*—W. E. Duncanson, Jr.
*Attorney, Agent, or Firm*—D. R. Lackey

[57] ABSTRACT

An elevator system including an elevator car, and control apparatus for controlling the speed of the elevator car, including a speed pattern generator. The speed pattern generator provides a running speed pattern and a slowdown speed pattern, and it forces the slowdown speed pattern to match the running speed pattern prior to transfer between the speed patterns, to achieve a stepless transfer therebetween. It also automatically adjusts the deceleration rate of the slowdown speed pattern prior to transfer, such that by maintaining the deceleration rate at its value at the time of transfer, the elevator car will be decelerated at a constant rate, and the slowdown speed pattern will have a predetermined value when the elevator car is at a predetermined location relative to the target floor, enabling stepless transfer at this predetermined location from the slowdown speed pattern to a landing speed pattern which is initialized to the predetermined value.

4 Claims, 3 Drawing Figures

ELEVATOR SYSTEM

BACKGROUND OF THE INVENTION

1. Field of the Invention

The invention relates in general to elevator systems, and more specifically to elevator systems in which the speed of an elevator car is controlled by a speed pattern generator.

2. Description of the Prior Art

U.S. Pat. No. 3,774,729, which is assigned to the same assignee as the present application, discloses an elevator system in which a speed pattern generator controls the speed of an elevator car by providing a time based speed pattern which accelerates the elevator car to, and then maintains, a predetermined running speed. When the elevator reaches a predetermined position relative to a target floor, the speed pattern generator substitutes a distance based speed pattern for the time based pattern, to control the speed of the elevator car during the slowdown phase of the run. Precise position control at the stopping floor, such as may be provided the shaped magnetic plates and associated transducers disclosed in U.S. Pat. Nos. 3,138,223, 3,207,265 and 3,507,360, which are assigned to the same assignee as the present application, may provide a landing speed pattern which is substituted for the slowdown speed pattern when the elevator reaches a predetermined location relative to the target floor, such as 10 inches from floor level.

In order to provide a high quality ride, without noticeable "bumps" in the elevator car during a run, the transfer from the time based or running speed pattern to the distance based slowdown speed pattern, and the transfer from the distance based slowdown speed pattern to the distance based landing pattern, must be stepless, i.e., the patterns must match at transfer time. Further, in order to provide a comfortable ride, the slowdown must be made at a constant deceleration rate.

An equation may be developed describing a distance based slowdown speed pattern which will start at a specified magnitude at a predetermined distance from the target floor, to cause it to match a like magnitude of the time based running speed pattern, to decelerate at a predetermined constant deceleration rate, and to have a predetermined value, equal to the initial value of the landing speed pattern at the predetermined distance from the target floor at which transfer to the landing speed pattern is to be made. This equation is developed as follows, assuming that the switch or transfer to the landing speed pattern is made 10 inches (0.833 foot) from the target floor:

$$V_x^2 - V_{HTAN} = 2d(X - 0.833) \quad (1)$$

where $V_x$ = the velocity of the elevator car at a distance X from the target floor $V_{HTAN}$ = the required velocity of the elevator car at the distance 0.833 foot from the target floor d = deceleration rate.

The desired car velocity $V_{HTAN}$ at 0.833 foot from floor level is known in terms of the desired pattern at 0.833 foot, which will be assumed to be 1.2 feet per second, for purposes of example, the deceleration rate d, and the system time lag T, as follows:

$$V_{HTAN} = 1.2 \text{ ft/sec} + Td \quad (2)$$

The distance to floor level will be assumed to be in the form of a digital count, which is converted to a voltage $V_d$, which will be assumed to be related to the distance to the floor by the following relationship:

$$X = V_D \times 17.6 \text{ ft/volt} \quad (3)$$

It will further be assumed that the slowdown speed pattern generator provides a speed pattern DSAN which has the following scale:

$$DSAN = 0.333 \text{ volt/ft/sec} \quad (4)$$

Combining equations (1) through (4) to relate the required speed pattern voltage DSAN to the distance to go voltage $V_D$, the deceleration rate d, and the system time lag T, results in:

$$DSAN = \sqrt{L_1(V_D - L_2)} - L_3 \quad (5)$$

where $L_1 = 3.79d$ $$L_2 = \frac{.185d - .267Td - .111\,T^2d^2 - .16}{L_1}$$

$$L_3 = .333Td$$

In prior art speed pattern generators of which I am aware, Equation (5) was implemented by subtracting $L_2$ from $V_D$ to provide signal $V_D - L_2$, multiplying $V_D - L_2$ by $L_1$ to provide $L_1(V_D - L_2)$, taking the square root of $L_1(V_D - L_2)$ to provide $\sqrt{L_1(V_D - L_2)}$, and then subtracting $L_3$ to provide $\sqrt{L_1(V_D - L_2)} - L_3$. The speed pattern generator was designed for a specific deceleration rate, such as 4 ft/sec$^2$. Provisions for different deceleration rates were made by making the multiplier function programmable with jumper plugs. This, in effect, changed the value of $L_1$ when a different deceleration rate was selected, and $L_2$ and $L_3$ remained unchanged. Thus, Equation (5) was only satisfied when the selected deceleration rate was 4 ft/sec$^2$, with poor performance at other deceleration rates.

Also, the prior art speed pattern generators require the transfer from the running speed pattern to the slowdown speed pattern to be made at precisely the correct point so that deceleration at the pre-programmed rate will bring the car accurately to the point of the landing pattern substitution. If slowdown is not initiated at exactly the right point, a mismatch between the running speed pattern and the slowdown speed pattern will occur and an undesirable "bump" will be felt in the elevator car at pattern transfer.

If an attempt is made to eliminate this mismatch, such as by developing a calibration voltage just prior to transfer, wherein the slowdown pattern voltage DSAN multiplied by the calibration voltage equals the voltage of the running speed pattern, and by "freezing" the calibration voltage at its value at the precise moment of transfer, an accurate match is made at the transfer point. However, since the distance slowdown pattern DSAN was set equal to the landing pattern at 0.833 ft. from floor level, the calibrated slowdown pattern DSAN is now multiplied by the calibration voltage. This results in a mismatch between the slowdown and landing patterns, and a poor landing. A poor landing is even more objectionable than the original problem, i.e., the mismatch at the higher speed transfer between the running and slowdown patterns.

SUMMARY OF THE INVENTION

The present invention is a new and improved elevator system of the type which uses multiple speed patterns to control the speed of an elevator car during a run. The speed pattern generator automatically adjusts the deceleration rate to be used by the slowdown speed pattern, just prior to transfer to the slowdown speed pattern, with the selected deceleration rate then being held constant during the time the slowdown pattern is effective. The required deceleration rate to decelerate from the present value of the running speed pattern, at a constant rate, to achieve the desired value of the slowdown speed pattern at the landing pattern transfer point, is arrived at by forcing the slowdown speed pattern to equal the running speed pattern by selecting a deceleration rate which achieves this equality. This selected deceleration rate is used in the calculation of $L_1$, $L_2$ and $L_3$, as the speed pattern DSAN is developed. Thus, when transfer occurs there is no mismatch between the running and slowdown speed patterns, as they were forced to be equal to one another. The deceleration rate during slowdown is constant, as it was frozen at its instantaneous value at transfer time. The slowdown speed pattern DSAN will have precisely the same value as the landing speed pattern at the landing speed pattern transfer point, as the required deceleration d is used to calculate all of the constants $L_1$, $L_2$ and $L_3$, and not just one of them as in the prior art. Finally, the self-adjusting feature provided by the ability of the elevator system to select the required deceleration rate removes the need for initiating deceleration at precisely the correct point. Errors in when deceleration is started can be tolerated since the pattern generator selects an appropriate deceleration rate based on when transfer actually occurs, and not when it should occur. This feature is extremely important, as it is often difficult to determine the correct point at which to begin deceleration. This determination is further complicated when two step acceleration is employed, or when the speed pattern is modified by clamping circuits.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENTS

Figure 1:
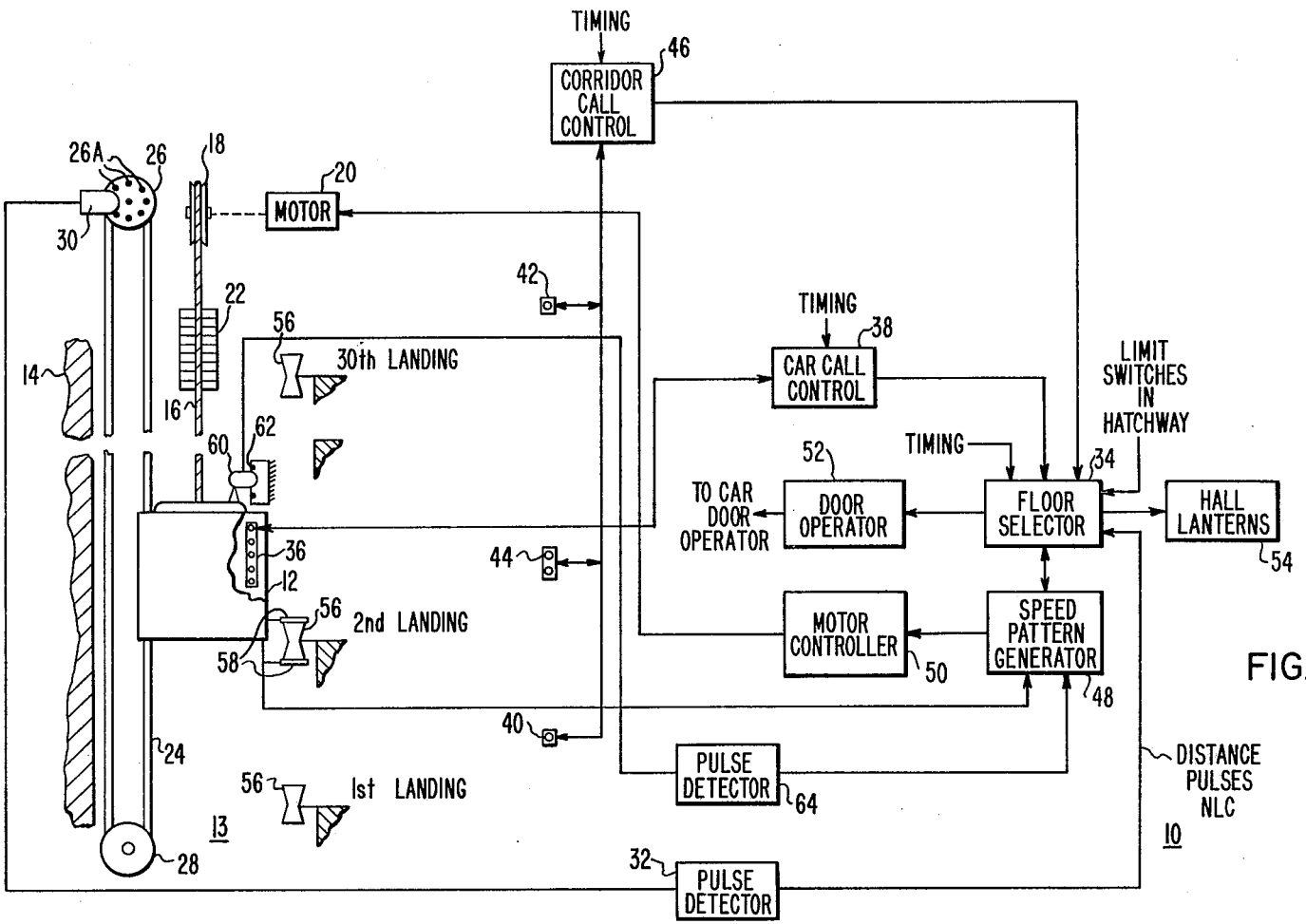
FIG. 1 is a partially schematic and partially block diagram illustrating an elevator system which may be constructed according to the teachings of the invention.
Figure 2:
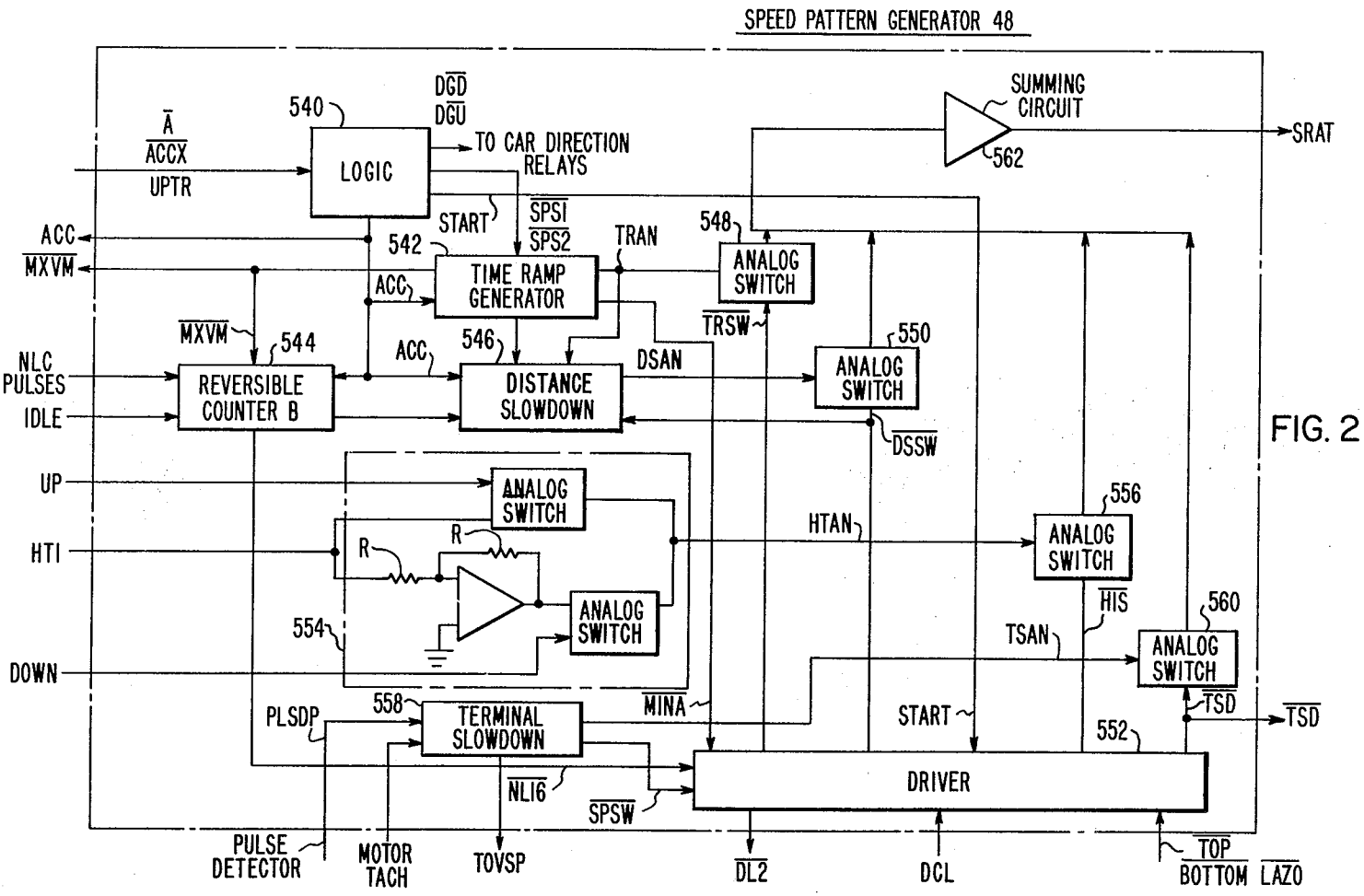
FIG. 2 is a block diagram of a speed pattern generator constructed according to the teachings of the invention, for use in the elevator system of FIG. 1.
Figure 3:
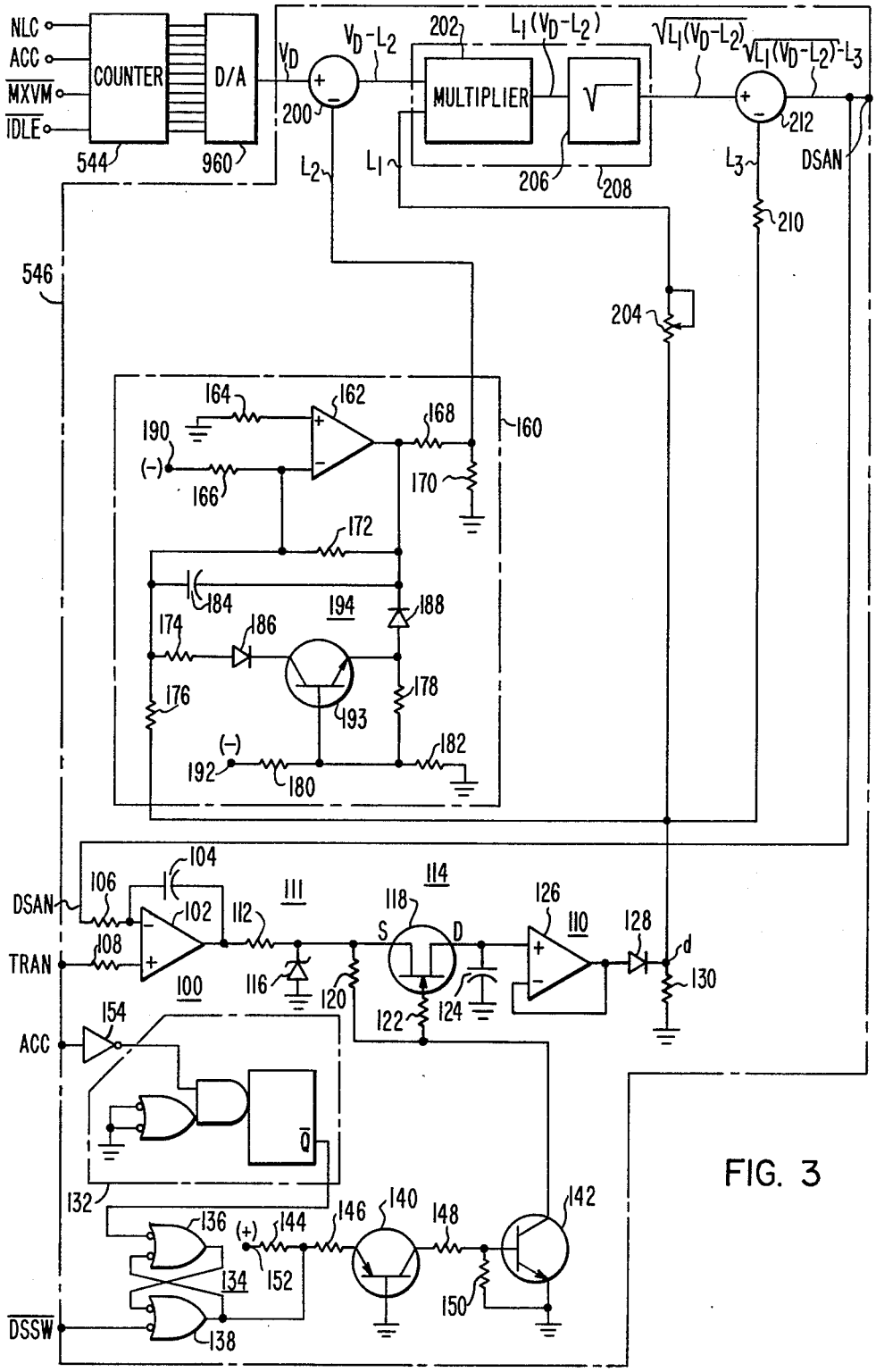
FIG. 3 is a schematic diagram of the distance slowdown portion of the speed pattern generator shown in block form in FIG. 2, which is constructed according to the teachings of the invention.

The invention is a new and improved elevator system, and in order to reduce the complexity of the drawing and specification the hereinbefore mentioned U.S. Pat. No. 3,774,729 is hereby incorporated into the present application by reference. The present invention will be described by illustrating how the elevator system of the incorporated patent would be modified to operate according to the teachings of the invention, and thus only the modifications thereto will be described in detail. FIG. 1 is the same as FIG. 1 of the incorporated patent, and is included to broadly show an elevator system of the type which may utilize the invention. FIG. 2 is similar to FIG. 12 of the incorporated patent, except for the addition of the running speed pattern signal TRAN and the switching signal $\overline{\text{DSSW}}$ as inputs to the distance slowdown speed pattern generator 546. The reference numerals in FIGS. 1 and 2 are the same as those in FIGS. 1 and 12, respectively, of the incorporated patent, for ease of comparison. The distance slowdown pattern generator 546 shown in FIG. 3 is new, and will be described with reference numerals starting at 100.

Briefly, FIG. 1 illustrates an elevator system 10 wherein a car 12 is mounted in a hatchway 13 for movement relative to a structure 14 having a plurality of landings, such as 30, with only the first, second and thirtieth landings being shown in order to simplify the drawing. The car 12 is supported by wire ropes 16 which are reeved over a traction sheave 18 mounted on the shaft of a drive motor 20, such as a direct motor as used in the Ward-Leonard, or in a solid state, drive system. A counterweight 22 is connected to the other ends of the ropes 16. A governor rope 24, which is connected to the car 12, is reeved over a governor sheave 26 located above the highest point of travel of the car in the hatchway 13, and over a pulley 28 located at the bottom of the hatchway. A pickup 30 is disposed to detect movement of the car 12 through the effect of circumferentially spaced openings 26A in the governor sheave 26. The openings in the governor sheave are spaced to provide a pulse for each standard increment of travel of the car, such as a pulse for each 0.5 inch of car travel. Pickup 30, which may be of any suitable type, such as optical or magnetic, provides pulses in response to the movement of the openings 26A in the governor sheave. Pickup 30 is connected to a pulse detector 32 which provides distance pulses NLC for a floor selector 34. Distance pulses NLC may be developed in any other suitable manner, such as by a pickup disposed on the car which cooperates with regularly spaced indicia in the hatchway.

Car calls, as registered by pushbutton array 36 mounted in the car 12, are recorded and serialized in car call control 38, and the resulting serialized car call information is directed to the floor selector 34. Corridor calls, as registered by pushbuttons mounted in the corridors, such as the up pushbutton 40 located at the first landing, the down pushbutton 42 located at the thirtieth landing, and the up and down pushbuttons 44 located at the second and other intermediate landings, are recorded and serialized in corridor call control 46. The rsulting serialized corridor call information is directed to the floor selector 34.

The floor selector 34 processes the distance pulses from pulse detector 32 to develop information concerning the position of the car 12 in the hatchway 13, and it also directs these processed distance pulses to a speed pattern generator 48 which generates a speed reference signal for a motor controller 50, which in turn provides the drive voltage for motor 20.

The floor selector 34 keeps track of the car 12, the calls for service for the car, it provides the request to accelerate signal to the speed pattern generator 48, and it provides the deceleration signal for the speed pattern generator 48. The deceleration signal is provided at the precise time required for the car to start the slowdown phase of the run to decelerate according to a predetermined deceleration schedule and stop at a predetermined target floor for which a call for service has been registered. The floor selector 34 also provides signals for controlling such auxiliary devices as the door operator 52 and the hall lanterns 54, and it controls the resetting of the car call and corridor call controls when a car or corridor call has been serviced.

Landing, and leveling of the car at the landing, is accomplished by a hatch transducer system which utilizes inductor plates 56 disposed at each landing, and a transformer 58 disposed on the car 12.

The motor controller 50 includes a speed regulator responsive to the reference pattern provided by the speed pattern generator 48. The speed control may be derived from a comparison of the actual speed of the motor and that called for by the reference pattern.

An overspeed condition near either the upper or lower terminal is detected by the combination of a pickup 60 and slowdown blades, such as a slowdown blade 62.

FIG. 2 is a block diagram of a speed pattern generator which may be used for the speed pattern generator 48 shown in FIG. 1. The speed pattern generator 48 provides a signal for the motor controller 50 which controls the speed of the drive motor 20, and thus the movement of the car 12. In elevator systems, the speed and position of the car must be precisely controlled for the safety and comfort of the passengers, while being responsive to calls for service at any time.

The speed pattern generator 48 receives signals $\overline{ACCX}$ and UPTR from the floor selector 34, responsive to a request for acceleration, and travel direction request, respectively, which signals are processed in logic circuit 540 to provide signals $\overline{DGU}$ and $\overline{DGD}$ for the car direction relays, acceleration signal ACC, speed signals $\overline{SPS1}$ or $\overline{SPS2}$ for a time ramp running speed pattern generator circuit 542, and a start signal START for a driver circuit 552. The running speed pattern generator 542 provides a time dependent signal TRAN which is used for the acceleration, full speed and transition between full speed and maximum deceleration phases of the run, with the speed pattern generator 48 automatically switching to distance dependent signals for the maximum deceleration and landing phases of the run, as will be hereinafter described.

A reversible counter 544 receives the distance pulses NLC. Counter 544 is responsive to signal $\overline{MXVM}$ from the running speed pattern generator 542, which goes to logic ZERO when maximum speed of the car is reached, and signal ACC goes to the logic ZERO level when deceleration is requested. These signals program counter 544 to (a) count up in response to the NLC distance pulses while the car is accelerated, to (b) stop counting when the car reaches maximum speed ($\overline{MXVM}$ goes to ZERO), which thus stores the distance to go to a landing, and to (c) count down when the deceleration is initiated (ACC goes to ZERO).

The output of counter 544 is applied to a distance slowdown circuit 546, which provides a speed reference signal DSAN. The switching from the time dependent running pattern signal TRAN to the distance dependent slowdown pattern signal DSAN is accomplished by switches 548 and 550 and a driver circuit 552 which provides switching signals $\overline{TRSW}$ and $\overline{DSSW}$ at the proper time for operating analog switches 548 and 550, respectively. Signal $\overline{DSSW}$ is also applied to the slowdown pattern generator 542 to freeze a signal related to a self-adjusting feature at its value at the time of the transfer or switch from the running to the slowdown speed patterns. The running pattern TRAN is also applied to the slowdown pattern generator 546, in order to enable a comparison, which will be hereinafter explained.

When the car is within a predetermined distance of the target floor at which it is to stop, such as 10 inches, a signal HT1 from a hatch transducer is applied to a switching arrangement 554, which is also responsive to the car travel direction, signals UP and DOWN. Signal UP is true when the car is traveling upwardly, and signal DOWN is true when the car is traveling downwardly. Switching arrangement 554 provides a speed reference signal HTAN (which corresponds to signal $V_{HTAN}$ used in the equations) for an analog switch 556, which receives a switching signal $\overline{HIS}$ from driver 552 at the proper time to switch from the slowdown speed reference signal DSAN to the hatch transducer speed reference signal HTAN.

The pulse detector 64 shown in FIG. 1 generates pulses in response to pickup 60 on the elevator car and slowdown blades 62 mounted in the hatch near the terminals. These pulses, referred to as PLSDP pulses, along with a signal from a tachometer on the drive motor 20, are applied to a terminal slowdown circuit 558. Terminal slowdown circuit 558 detects car overspeed near a terminal, and when overspeed is detected, it provides a speed reference signal TSAN for stopping the car at the terminal the car is approaching. Signal TSAN is switched into circuit effect by analog switch 560, which receives a switching signal $\overline{TSD}$ from drive 552. If the overspeed condition detected by terminal slowdown circuit 558 exceeds a predetermined magnitude, a signal TOVSP is generated which is applied to emergency stopping control (not shown), which may be conventional.

The signals from the analog switches driven by the driver 552 are applied to a summing amplifier 562, which provides a speed reference signal SRAT for the motor controller 50, shown in FIG. 1, which may be conventional.

Referring now to FIG. 3, there is shown a slowdown speed pattern generator 546 constructed according to the teachings of the invention. Slowdown speed pattern generator 546 automatically forces the slowdown speed signal DSAN to match the value of the running speed pattern TRAN at transfer, assuring a smooth transition and removing the criticality as to exactly when switching occurs. Also, it automatically selects the correct constant deceleration rate d to be used in developing the slowdown speed pattern DSAN in order to arrive at the initial value of the hatch transducer pattern HTAN precisely at the transfer point, to assure a smooth, bumpless landing.

More specifically, the output of counter 544 is applied to a digital to analog converter 960, such as Zeltex 2D432, in order to convert the binary count, representative of the distance of the elevator car from the target floor, to an analog voltage signal $V_D$. When the elevator car is to stop at a selected target floor, signal ACC goes low precisely when the elevator car reaches the distance from the target floor which corresponds to the binary count already in the counter. Counter 544 then starts counting down in response to the distance pulses NLC, when signal ACC goes low. Broadly, the slowdown speed pattern generator 546 takes the square root of the distance-to-go signal $V_D$ to develop the speed pattern DSAN. Transfer from the running speed pattern TRAN to the slowdown speed pattern DSAN, however, is not made at this time. When signal ACC goes low, the running speed pattern TRAN starts a transition phase, with the transfer to the slowdown speed pattern being made at the end of this transition phase. As hereinbefore stated, this transition in prior art elevator systems, between the running and slowdown speed patterns, will only be smooth when it occurs at precisely the right time, for a specific deceleration rate. A non-precise transfer and/or operating the elevator system at a different deceleration rate, produces a noticeable bump in the elevator car due to the step change in the speed pattern.

The present invention compares the running speed pattern TRAN with the slowdown speed pattern DSAN when signal ACC goes low and DSAN is initiated, with the comparison persisting up to the signal transfer point. This comparison circuit develops a deceleration signal d for the circuitry which processes the distance signal $V_D$, adjusting the deceleration signal d as required to cause the slowdown speed pattern DSAN to match the running speed pattern TRAN. Thus, when transfer occurs, the transfer is smooth, regardless of whether or not the transfer is made precisely at the correct time. The deceleration rate d is then "frozen" at transfer, to provide a constant rate of deceleration, as required for ride comfort. The processing circuitry which processes signal $V_D$ and the desired deceleration signal d to obtain the slowdown speed pattern DSAN implements Equation (5), thus assuring that the slowdown speed pattern DSAN and the landing pattern HTAN will match at the 10 inch transfer point.

More specifically, the slowdown speed pattern DSAN is compared with the running speed pattern TRAN in a differential amplifier and integrator circuit 100, which includes an operational amplifier (op amp) 102, a feedback capacitor 104 and input resistors 106 and 108. The output of the differential amplifier and integrating circuit 100 is applied to a high input impedance follower 110 via a track and hold circuit 111 which includes a resistor 112, a switch 114, and a capacitor 124. The input to switch 114 may be limited to a predetermined maximum value by a Zener diode 116.

Switch 114 may include a junction field effect transistor (JFET) 118 and resistors 120 and 122. When switch 114 is conductive, the track and hold circuit 111 is in its "track" mode, and when it is non-conductive, the circuit is in its "hold" mode, with the charge on capacitor 124 representing the output of switch 114 at the time it is switched to its non-conductive state. Capacitor 124 is connected to the high input impedance follower 110. Follower 110 may include an op amp 126 which has its non-inverting input connected to be responsive to the charge on capacitor 124, and its output connected to its inverting input. The output of op amp 126 is connected to ground via a diode 128 and a resistor 130, with the voltage across resistor 130 providing the deceleration voltage d.

The conductive state of swtich 114 is controlled by an arrangement which includes a monostable multivibrator 132, such as T.I.'s Ser. No. 74121, a flip-flop 134, such as a flip flop formed of cross-coupled NAND gates 136 and 138, a PNP transistor 140, an NPN transistor 142, resistors 144, 146, 148, and 150, and a positive source 152 of unidirectional potential.

Signal ACC is applied to the monostable multivibrator 132 via an inverter 154. When signal ACC goes low to signal the start of the slowdown phase of the run, the high output of inverter 154 triggers the monostable 132 to provide a one-shot negative going pulse at its $\overline{Q}$ output, causing flip-flop 134 to provide a logic zero at the output of NAND gate 138. The logic zero turns off transistor 140 and removes base drive from transistor 142, turning it off. Thus, JFET 118 turns on, initiating the track mode of circuit 111. The charge on capacitor 124 follows the output voltage of the differential amplifier and integrator circuit 100.

When the transfer from the running speed pattern TRAN to the slowdown speed pattern DSAN is to be made, signal $\overline{DSSW}$ goes low. This resets flip-flop 134, switching the output of NAND gate 138 high, turning on transistors 140 and 142, and turning off switch 114. Capacitor 144 thus holds its charge at the instant signal $\overline{DSSW}$ goes low, providing a constant input voltage for follower 110 during the slowdown phase. Thus, the deceleration signal d is constant.

The slowdown pattern generator 546 processes the distance-to-go voltage $V_D$ and the selected deceleration rate d according to Equation (5). A signal $L_2$ is developed in the non-linear circuit 160 in response to the deceleration signal d. Circuit 160 includes an amplifier having an op amp 162, resistors 164, 166, 168, 170, 172, 174, 176, 178, 180, and 182, a capacitor 184, diodes 186 and 188, negative sources 190 and 192 of unidirectional potential, and an NPN transistor 193.

Op amp 162 has its non-inverting input connected to ground via resistor 164, and its inverting input is connected to negative source 190 via resistor 166, and also to a feedback circuit 194 connected from its output to its inverting input. Its output is connected to ground via serially connected resistors 168 and 170, with their junction providing a voltage equal to $L_2$. Feedback circuit 194 provides feedback as a non-linear function of d, designed to produce an output $L_2$ closely approximating:

$$\frac{.185d - .267Td - .111T^2d^2 - .16}{L_1},$$

in the ranges of d and T of interest, where d = the deceleration rate and T = the system time delay. Feedback circuit 194 includes resistor 172 connected from the output of op amp 162 to its inverting input, a capacitor 184 connected across resistor 172, a serial circuit connected across resistor 172 which includes resistor 174, diode 186, transistor 193 and diode 188. Resistors 178 and 182 are connected from the emitter of transistor 193 to ground, resistor 180 is connected from source 192 to the junction between resistors 178 and 182, and the base of transistor 193 is also connected to this junction. The signal which represents the deceleration rate d is connected to the inverting input of op amp 162 via resistor 176.

Signal $L_2$ is subtracted from the distance-to-go signal $V_D$ in a summing junction or circuit 200, to provide a signal $V_D - L_2$ at the output of the junction, which is applied to one input of a multiplier function 202. The other input of multiplier function 202 is connected to receive signal d via an adjustable resistor 204. Resistor 204 is set to effectively provide a signal 3.79d, which is thus the same as signal $L_1$, by setting resistor 204 to adjust the gain of multiplier function 202 to provide an output of $3.79d(V_D-L_2)$. The output of the multiplier function 202, which is equal to $L_1(V_D-L_2)$, is applied to a square root function 206, the output of which is equal to $\sqrt{L_1(V_D-L_2)}$. The functions of multiplier 202 and square root circuit 206 may be provided by a single multifunction generator, indicated generally by broken outline 208, such as Burr Brown's 4302.

A resistor 210 is selected to provide a signal equal to 0.333Td, which is thus the same as signal $L_3$, and this signal is subtracted from the output of the multifunction generator 208 in a summing junction or circuit 212, providing an output equal to the $\sqrt{L_1(V_D-L_2)}-L_3$ which is the same as Equation (5). Thus, the slowdown speed pattern signal DSAN, when the slowdown speed pattern circuits are constructed according to the teachings of the invention, follows Equation (5).

In summary, there has been disclosed a new and improved elevator system of the type which utilizes a plurality of speed patterns in order to direct the speed of an elevator car throughout a run. High ride quality is assured by selecting the required deceleration rate on each run, just prior to transfer to the slowdown speed pattern, with processing circuitry being responsive to the distance of the elevator car from the target floor and to this selected deceleration rate, to provide a slowdown speed pattern signal which starts precisely at the value of a running speed pattern at transfer time, and which precisely matches the landing speed pattern at the landing speed point, and it provides a constant deceleration rate between these two points. Further, the present invention eliminates the criticality in trying to switch from the running to the slowdown speed patterns precisely at the proper point, as the slowdown speed pattern is forced to match the running speed pattern right up to the transfer point.

I claim as my invention:

1. An elevator system, comprising:

a structure having a plurality of floors, an elevator car mounted for movement in said structure to serve the floors, motive means for causing said elevator car to make a run and stop at a target floor, and control means for said motive means, including speed pattern means for providing a speed pattern signal indicative of the desired speed of the elevator car during at least a portion of a run, said speed pattern means including first means providing a running speed pattern which controls the speed of the elevator car up to a transfer point, second means providing a slowdown speed pattern after a target floor has been selected, but prior to said transfer point, said second means including distance means providing a distance signal continuously responsive to the distance of the elevator car from the target floor, and processing means processing said distance signal as a function of deceleration and a predetermined control system constant, wherein the deceleration rate used by the processing means is that rate which is required to decelerate the elevator car at a constant rate from the present value of the slowdown speed pattern and provide a predetermined slowdown pattern value at a predetermined location relative to the target floor, third means transferring speed control of the elevator car to said slowdown speed pattern at said transfer point and terminating such control by said running speed pattern, and fourth means providing a deceleration signal d representative of the deceleration rate to be used by the processing means of said second means, said fourth means providing said deceleration signal d in response to said slowdown speed pattern and to said running speed pattern, adjusting the magnitude of said deceleration signal d as required to cause the slowdown speed pattern to match the running speed pattern prior to the transfer point, to provide a stepless transition at the transfer point, said fourth means further including means maintaining the value of the deceleration signal at its value at the time of the transfer point during the time the slowdown speed pattern is controlling the speed of the elevator car, to provide a constant deceleration rate and cause the slowdown speed pattern to have a value equal to said predetermined value at said predetermined location relative to the target floor.

2. The elevator system of claim 1 wherein the speed pattern means includes fifth means providing a landing speed pattern having a predetermined initial value, and sixth means transferring speed control of the elevator car to said landing speed pattern at a predetermined location relative to the target floor, and wherein the predetermined initial value and predetermined location are the same as the predetermined value and the predetermined location, respectively, used by the second means in developing the slowdown speed pattern, to provide a stepless transition at the transfer point between the slowdown speed pattern and landing speed pattern.

3. The elevator system of claim 1 wherein the processing means includes means subtracting a predetermined non-linear function of the deceleration signal d from the distance signal to provide a first intermediate signal, means multiplying the first intermediate signal by a predetermined linear function of d, to provide a second intermediate signal, means providing a third intermediate signal responsive to the square root of the second intermediate signal, and means subtracting a predetermined linear function of d from the third intermediate signal to provide the slowdown speed pattern.

4. The elevator system of claim 1 wherein the predetermined control system constant used by the processing means is the system response time.

* * * * *